United States Patent [19]

Childs

[11] Patent Number: 4,776,294

[45] Date of Patent: Oct. 11, 1988

[54] SHIP STABILIZER ASSEMBLY

[76] Inventor: John M. Childs, 13031 Deva St., Coral Gables, Fla. 33156

[21] Appl. No.: 61,821

[22] Filed: Jun. 15, 1987

[51] Int. Cl.[4] ..... B63B 39/06

[52] U.S. Cl. ..... 114/126; 114/152

[58] Field of Search ..... 114/126, 152, 284, 67 R, 114/279, 280; 441/77; 440/14

[56] References Cited

U.S. PATENT DOCUMENTS

| | | | |
|---|---|---|---|
| 2,151,836 | 3/1939 | Bugatti | 114/284 |
| 2,584,347 | 2/1952 | Hazard | 114/280 |
| 2,892,435 | 6/1959 | Ljungstrom | 114/122 |
| 3,004,510 | 10/1961 | Nawara | 114/126 |
| 3,015,298 | 1/1962 | Bell et al. | 114/126 |
| 3,018,749 | 1/1962 | De Beurs | 114/126 |
| 3,075,490 | 1/1963 | Lang | 115/41 |
| 3,112,504 | 12/1963 | Carlton | 441/77 |
| 4,003,325 | 1/1977 | Allen | 114/56 |
| 4,276,668 | 7/1981 | Lefebvre | 9/2 A |

FOREIGN PATENT DOCUMENTS

| | | | |
|---|---|---|---|
| 1225240 | 6/1960 | France | 114/126 |
| 326058 | 1/1958 | Switzerland | 114/126 |

*Primary Examiner*—Sherman D. Basinger
*Attorney, Agent, or Firm*—Oltman and Flynn

[57] ABSTRACT

A water vessel with a bow-mounted pitch stabilizer having a rigid support structure attached to the bow and projecting in front of it, and one or more horizontally pivoted flaps on the support structure below the vessel's water line for opposing the up or down movement of the bow in the water. Roll stabilizers on opposite sides of the vessel's hull below the water line each comprise a hinged horizontal vane which is spring-biased to position substantially coplanar with the fixed vane.

18 Claims, 4 Drawing Sheets

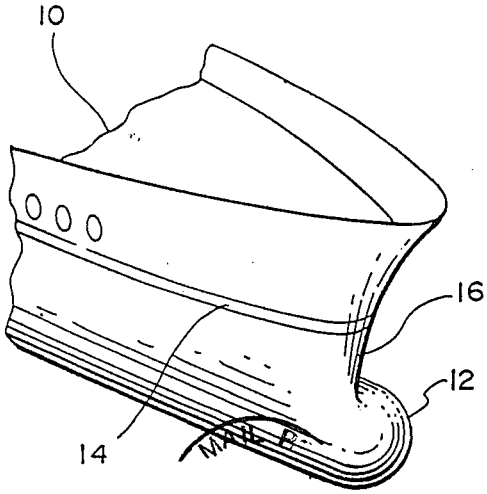
PRIOR ART FIG.1
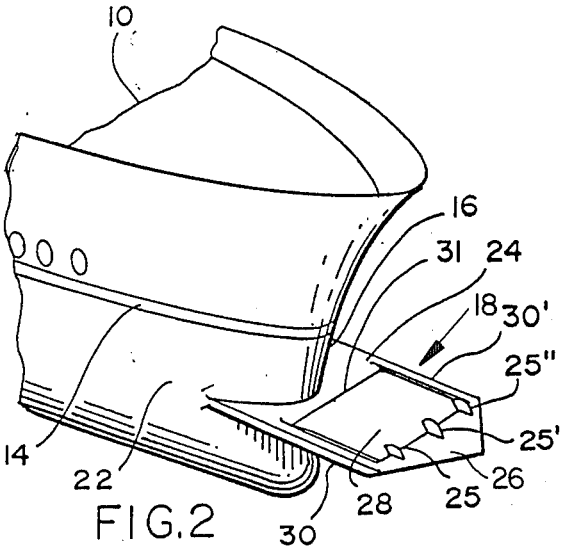
FIG.2
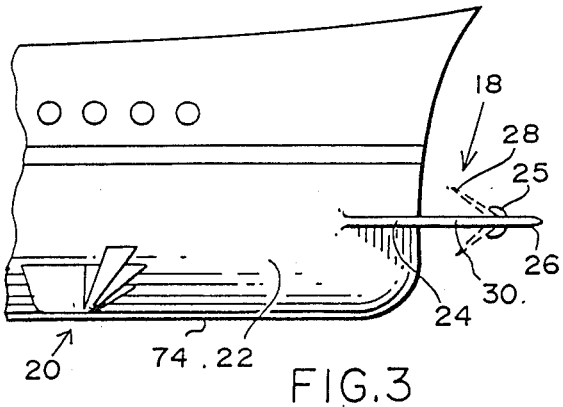
FIG.3
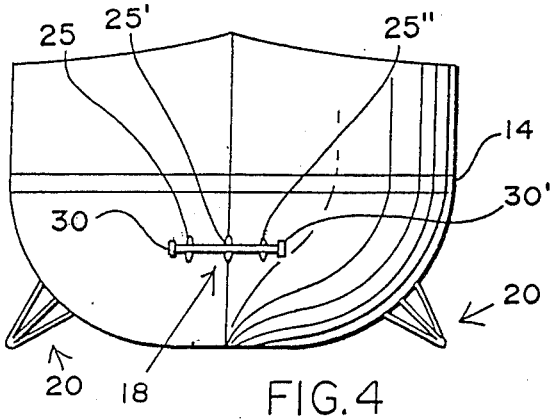
FIG.4
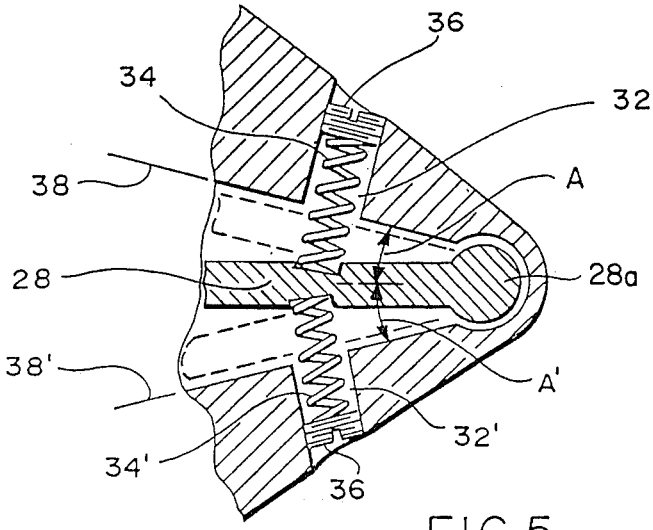
FIG.5

SHIP STABILIZER ASSEMBLY

SUMMARY OF THE INVENTION

This invention relates to a water vessel with a bow-mounted pitch stabilizer and/or roll stabilizers.

A well-known stabilizer for water vessels is a bulbous nose which extends forward from the bow below the water line. This type of stabilizer has improved the stability of water vessels and the efficiency and speed at which they move through the water. One disadvantage is that it must be part of the original design and construction of the vessel; as a practical matter, it cannot be retrofitted to an already constructed hull.

One aspect of the present invention is concerned with a novel pitch stabilizer mounted on the bow of a vessel below the water line, either as part of the original construction or as a later-added feature. Preferably, this pitch stablizer comprises a rigid support structure attached to and extending forward from the bow and horizontally pivoted flap means on this support structure for deflecting and directing aft the water just ahead of the bow as it pitches up and down in the water.

Another aspect of this invention is concerned with roll stabilizers on the opposite sides of the hull behind the bow and below the water line. Preferably, each roll stabilizer comprises a fixed horizontal vane with a laterally outwardly and rearwardly inclined front edge, a horizontally pivoted flap directly behind the fixed vane and presenting a laterally and inwardly inclined back edge, and spring means acting between the fixed vane and the pivoted flap to bias the flap to a horizontal position directly behind and substantially coplanar with the fixed vane.

A principal object of this invention is to provide a novel pitch stabilizer on the bow of a water vessel below the water line which will aid the forward movement of the vessel.

Another object of this invention is to provide a novel roll stabilizer on the side of a water vessel's hull below the water line which will aid the forward movement of the vessel.

Further objects and advantages of this invention will be apparent from the following detailed description of a presently preferred embodiment which is illustrated schematically in the accompanying drawings.

DESCRIPTION OF THE DRAWINGS

FIG. 1 is a perspective view of the bow of a water vessel having a bulbous nose below the water line in accordance with known prior art;

FIG. 2 is a similar view of the bow of a vessel having a bow-mounted pitch stabilizer in accordance with a first embodiment of the present invention;

FIG. 3 is a side elevation of the FIG. 2 vessel;

FIG. 4 is a front elevation of the FIG. 2 vessel;

FIG. 5 is a vertical longitudinal section through one of the pivot chocks for the pivoted pitch stabilizer flap in FIG. 2;

Figure 6:
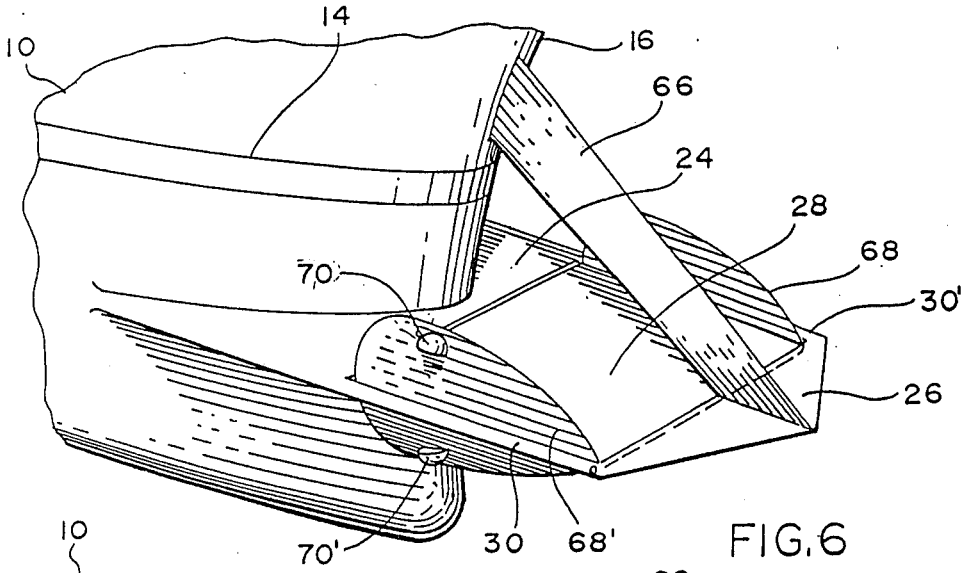
FIG. 6 is a perspective view of the bow of a vessel with a second bow-mounted pitch stabilizer in accordance with the present invention.

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

DETAILED DESCRIPTION

FIG. 1 shows the bow 16 of a water vessel 10 having a forwardly and laterally projecting bulbous nose 12 of known design below the vessel's water line 14. This bulbous nose has proven to be an effective way to reduce the vessel's pitch and roll and to increase its speed.

In accordance with the present invention, a pitch stabilizer having one or more horizontally pivoted plates or fins is provided in front of the bow of a water vessel, either as part of the original construction or as a retrofitted feature added to a vessel originally designed and built without it.

As shown in FIG. 2, the stabilizer has a rigid, flat support plate 24 rigidly attached to the vessel's hull and extending horizontally forward from the bow 16 below the vessel's water line 14. The support plate 24 extends laterally on opposite sides of the longitudinal centerline of the vessel and is symmetrical with respect to this centerline. The support plate on opposite sides presents narrower, forwardly projecting, flat, rigid arms 30 and 30'. A generally V-shaped leading end segment 26 of the support plate is joined to and extends between the front ends of its opposite side arms 30 and 30' and substantially coplanar with those side arms. Thus, the leading end segment 26 of support plate 24 is completely below the vessel's water line 14 and completely above the bottom of its bow 16. Behind its leading end segment 26 and between its opposite side arms 30 and 30' the support plate 24 presents a rectangular opening in which a single pivoted plate-like flap 28 is located.

The front end of pivoted flap 28 is pivoted in a center chock 25' and in side chocks 25 and 25'' respectively located a short distance laterally inward from the respective side arms 30 and 30' of the support plate. These chocks are all rigidly affixed to the back of the leading end segment 26 of the support plate and they define a horizontal pivot axis for flap 28 which extends perpendicular to the longitudinal centerline of the vessel. Thus, the flap 28 is pivoted on the support plate 24 below the water line 14 and above the bottom of bow 16. The rear edge 31 of pivoted flap 28 has a slight clearance from the rear edge of the opening in support plate 24, and the opposite side edges of flap 28 also have slight clearances from the adjacent inner longitudinal edges of side arms 30 and 30' of the support plate.

FIG. 5 shows a section through one of the pivot chocks 25 for flap 28. The flap has a rounded, slightly enlarged front end segment 28a horizontally pivoted in the body of the chock. A short distance behind this pivot the body of the chock presents upper and lower screw-threaded openings 32 and 32', each inclined inward and rearward at a small angle to the vertical. Adjusting screws 36 and 36' are threadedly received in these openings, and coil springs 34 and 34' are engaged under compression between these screws and the top and bottom, respectively of the pivoted flap 28. These springs center the pivoted flap 28 horizontally in a generally V-shaped opening in the chock which is bounded by rearwardly-diverging top and bottom surfaces 38 and 38'. The pivoted flap 28 can move up through an angle A or down through an equal angle A' from its centered horizontal position, as shown in phantom in FIGS. 3 and 5.

Except during violent pitching of the vessel, the stabilizer is below the vessel's water line 14. Downward movement of the bow causes upward pivoting of the flap 28 in the stablizer, which is opposed by the upper spring 34. Upward movement of the bow causes the water to pivot the flap 28 downward, which is opposed by the lower spring 34'. In either situation, water in front of the bow is deflected rearward by the flap 28 before the bow reaches it. The overall effect of this stabilizer is to reduce the amplitude of the pitch and consequently to increase the efficiency and speed of the vessel's movement forward in the water.

As shown in FIGS. 3 and 4, the vessel also has roll stabilizers 20 projecting out from the hull below the water line 14 and at a lower level than the bow-mounted pitch stabilizer 18. These roll stabilizers may be constructed as shown in either FIG. 13 or FIG. 14 and described in detail hereinafter.

Figure 7:
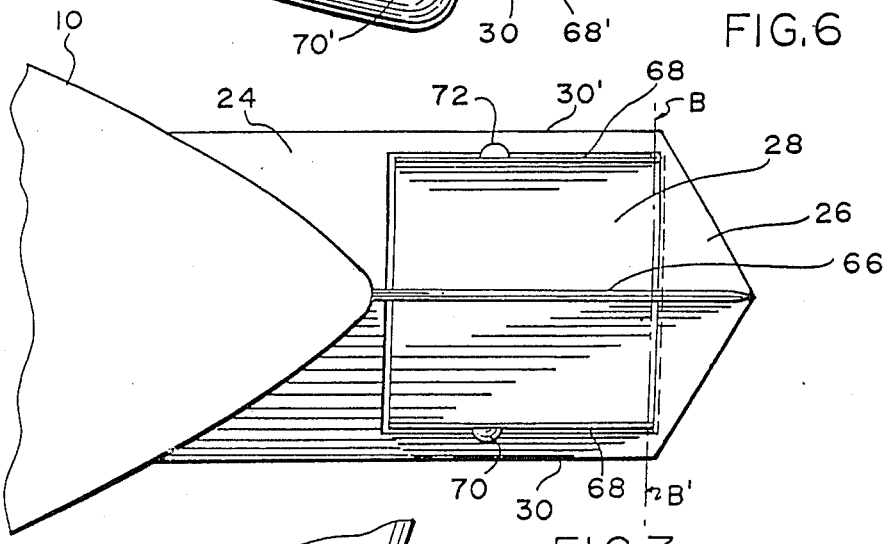
FIG. 7 is a top plan view of this second pitch stabilizer.
Figure 8:
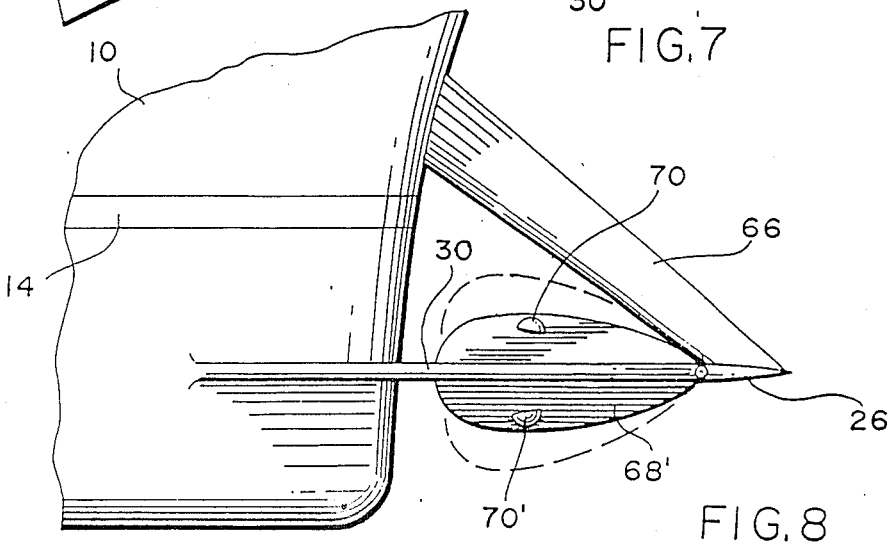
FIG. 8 is a side elevation of this second pitch stabilizer.

FIGS. 6–8 show a second embodiment of the bow-mounted pitch stabilizer according to the present invention. It has a support plate 24 identical to the one in FIGS. 2–5, including opposite side arms 30 and 30' and a generally V-shaped leading end segment 26. It has a pivoted flap 28 like the one in FIGS. 2–5 which is pivoted to the support plate across the back of the support plate's leading end segment 26. The pivotal axis of flap 28 extends horizontally and perpendicular to the longitudinal centerline of the vessel.

A rigid diagonal brace or strut 66 extends forward and downward at an acute angle from the bow 16 of the water vessel to the leading end segment 26 to reinforce the entire support plate 24.

The horizontally pivoted flap 28 has rigid, plate-like, vertical fins 68 and 68' extending above and below it along its opposite side edges close to the opposite side arms 30' and 30 of support plate 24. Each of these fins has a streamlined curvature above and below the flap 28, presenting a convex front edge away from the bow 16 of the vessel and a convex back edge of greater curvature. Fin 68' carries upper and lower projections or chocks 70 and 70' which project out laterally from it near the top and bottom. These projections are engageable with the adjacent side arm 30 of support plate 24 to limit the pivotal movement of flap 28 upward and downward with respect to the support plate. The fin 68 on the opposite side of flap 28 carries similar upper and lower projections or chocks, the upper of which is designated by reference number 70 and 72 in FIG. 7. These projections on fin 68 are engageable respectively with the top and bottom of the adjacent side arm 30' of support plate 24 to limit the pivotal movement of flap 28.

The flap 28 in this embodiment may be horizontally pivoted in the absence of centering springs as shown in FIG. 5 or in the presence of such springs. In either case, the vertical fins 68 and 68' on flap 28 causes it to act as a sluice for channeling the flow of water past the pitch stabilizer as the vessel moves forward thus increasing forward progress.

Figure 9:
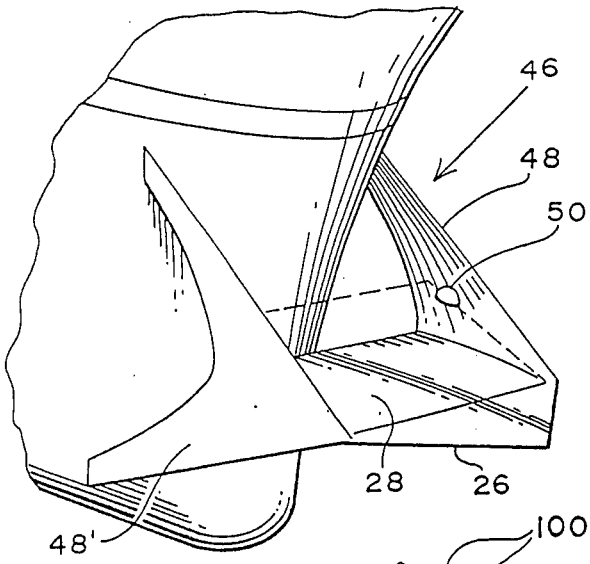
FIG. 9 is a perspective view of the bow of a vessel with a third bow-mounted pitch stabilizer according to this invention.
Figure 10:
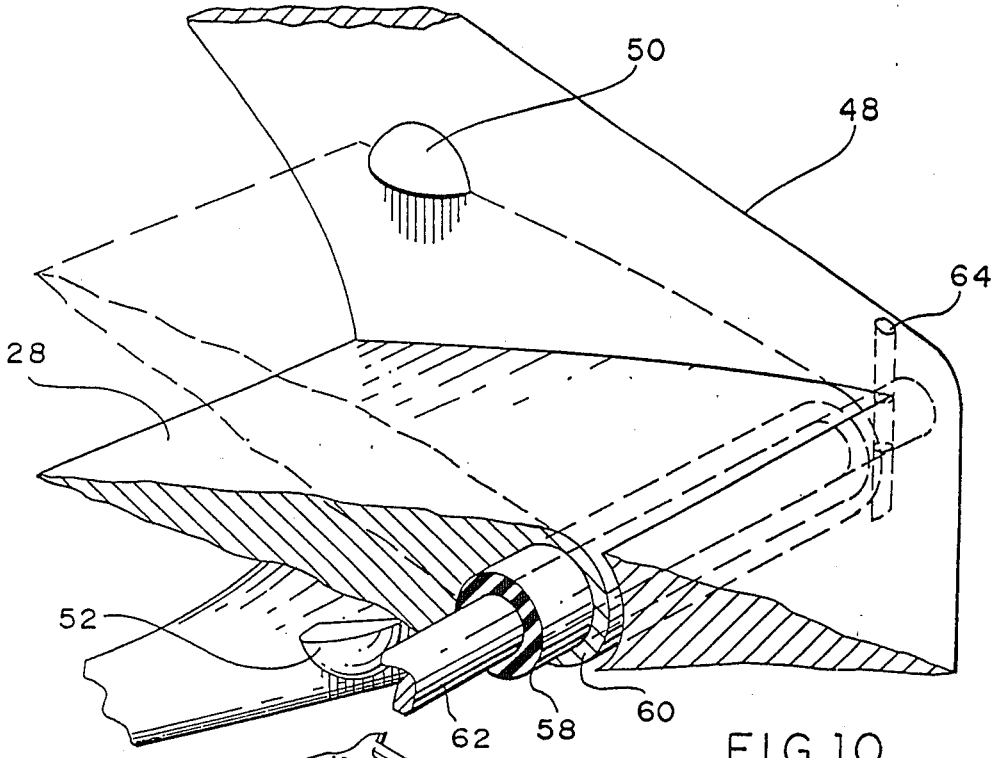
FIG. 10 is an enlarged fragmentary perspective view of this third pitch stablizer, with parts broken away to reveal the torsion spring.

FIGS. 9 and 10 show a third embodiment of the invention in which the centering springs 34 and 34' of FIG. 5 are replaced by a sleeve 58 (FIG. 10) of rubber or rubber-like material which is bonded to the flap 28 in the enlarged rounded front end 60 of the flap. Sleeve 58 is fastened around a horizontal shaft 62 which defines the pivot axis of flap 28.

A pair of rigid, vertical, generally V-shaped struts or braces 48 and 48' (FIG. 9) extend forward from the bow on opposite sides of the longitudinal centerline of the vessel parallel to each other. These struts support a generally V-shaped leading end segment 26, which is positioned horizontally in front of the bow as in the preceding embodiments of the invention. The struts 48,48' and the leading end segment 26 together provide a rigid bow-mounted support for the horizontal flap 28.

Shaft 62 has its opposite ends received in struts 48 and 48' at their front ends. At each end of shaft 62, a cross pin 64 anchors it to the corresponding strut.

The rubber-like sleeve 58 acts as a torsion spring between the support struts 48,48' and the pivoted flap 28, normally positioning the flap 28 horizontal, extending rearward from the leading end segment 26 of the support, and yieldingly opposing the pivotal displacement of the flap up or down from this centered horizontal position.

As shown in FIG. 10, strut 48 carries inwardly projecting upper and lower stops 50 and 52 which limit the pivotal movement of flap 28 in either direction. The opposite strut 48' has similarly located inwardly projecting stops (not shown) for engagement by flap 28.

Figure 11:
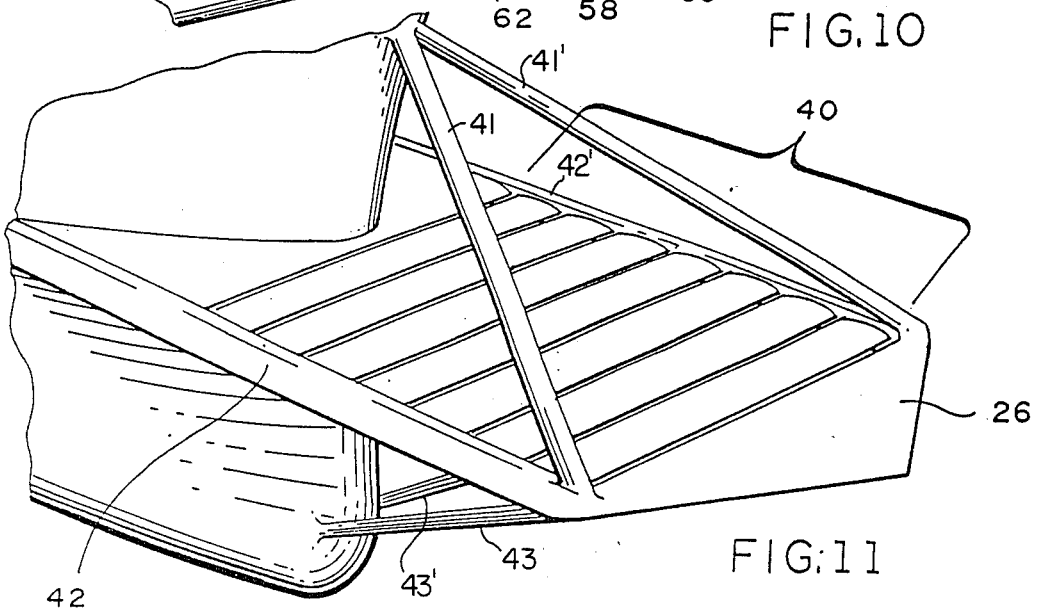
FIG. 11 is a perspective view showing a fourth bow-mounted pitch stabilizer according to this invention, having a plurality of horizontally pivoted flaps in succession from front to back.
Figure 12:
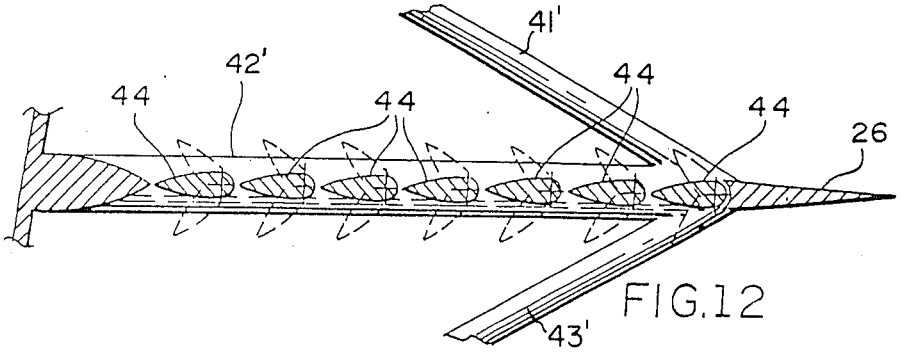
FIG. 12 is a longitudinal vertical section through the pitch stabilizer of FIG. 11.

FIGS. 11 and 12 show a fourth embodiment of the invention having several horizontally pivoted flaps in close succession from front to back instead of the single flap as shown in the first three embodiments. As a group, these flaps are indicated by the reference numeral 40 in FIG. 11. The individual flaps are designated by the reference numeral 44 in FIG. 12.

The bow-mounted support for the multiple flaps 44 comprises opposite horizontal side rails 42 and 42' and a generally triangular, horizontal front end segment 26 extending between the front ends of these side rails. Upper diagonal struts 41 and 41' extend from the bow 16 down and out to the front ends of side rails 42 and 42'. Lower diagonal struts 43 and 43' extend from the bow up and out to the front ends of the side rails.

As shown in FIG. 12, each flap 44 has a stream-lined cross-section, with a rounded convex front end and a tapered rear end. Each flap 44 is horizontally pivoted near its front end on the opposite side rails 42 and 42', either with or without spring-loading to the horizontal position. The horizontal pivot axis of each flap extends perpendicular to the longitudinal centerline of the vessel. These multiple flaps distribute the water forces over more than one flap and along the length of the side rails 42,42' of the support.

In each of the foregoing embodiments, each pivoted flap opposes or retards the instantaneous up or down movement of the bow in the water and thereby tends to reduce the amplitude of the vessel's pitching. Also, each pivoted flap deflects the water aft just ahead of the bow to improve the efficiency of the vessel's movement forward in the water.

The roll stabilizers 20 (FIGS. 13 and 14) are mounted on the opposite sides of the vessel's hull below the water line 14 but they do not project below the keel 74.

Figure 14:
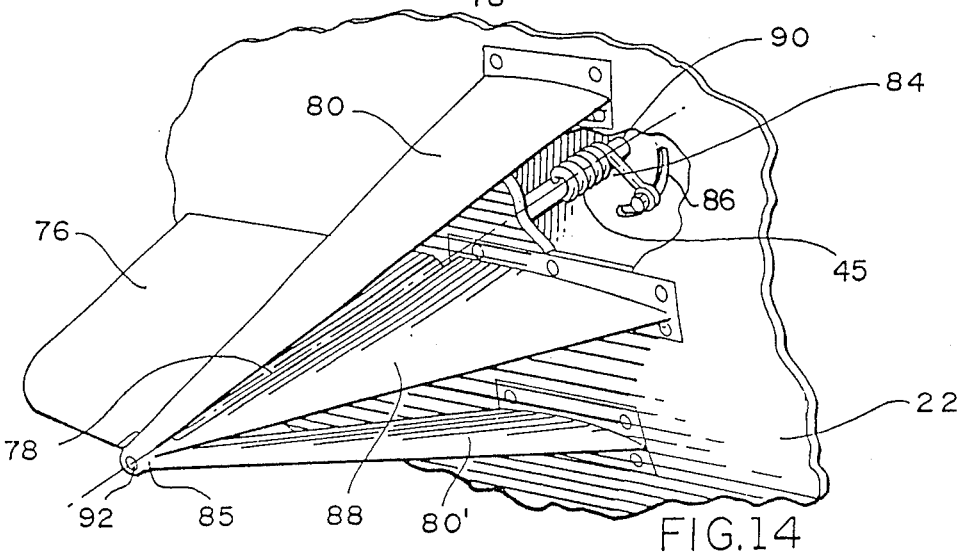
FIG. 14 is a similar view showing a different embodiment of the roll stabilizer according to the present invention.

Referring to FIG. 14, each roll stabilizer 20 has rigid upper and lower struts 80 and 80' which extend out from the hull 22 of the vessel at slight angles respectively downward and upward. A rigid middle strut 88 extends horizontally out from the hull and is joined at its outer end to the outer ends of upper and lower struts 80 and 80'. Each strut 80,80' and 88 is a flat plate. The middle strut 88 has a rearwardly and outwardly inclined, straight front edge. The middle strut 88 is a fixed, horizontal vane of the roll stabilizer.

A horizontal pivot shaft 78 extends out from the hull, with its inner end rotatably supported by an anti-friction bearing 90 inside the hull and its outer end rotatably supported by an anti-friction bearing 92 on the joined outer ends of struts 80,80' and 88. A torsion spring 45, with one end anchored in shaft 78, has several spiral turns wrapped around this shaft and has its opposite end supported inside the hull at any selected point along an arcuate slot 86 by a suitable clamping arrangement. The position to which this end of spring 45 is adjusted determines the torsional or rotational force which this spring exerts on shaft 78 and also will center vane 76.

Shaft 78 supports the front end of a flat, rigid, plate-like flap 76. Spring 45 is adjusted so that normally the shaft 78 positions flap 76 horizontally co-planar with the middle strut or fixed vane 88 and directly behind it.

Figure 13:
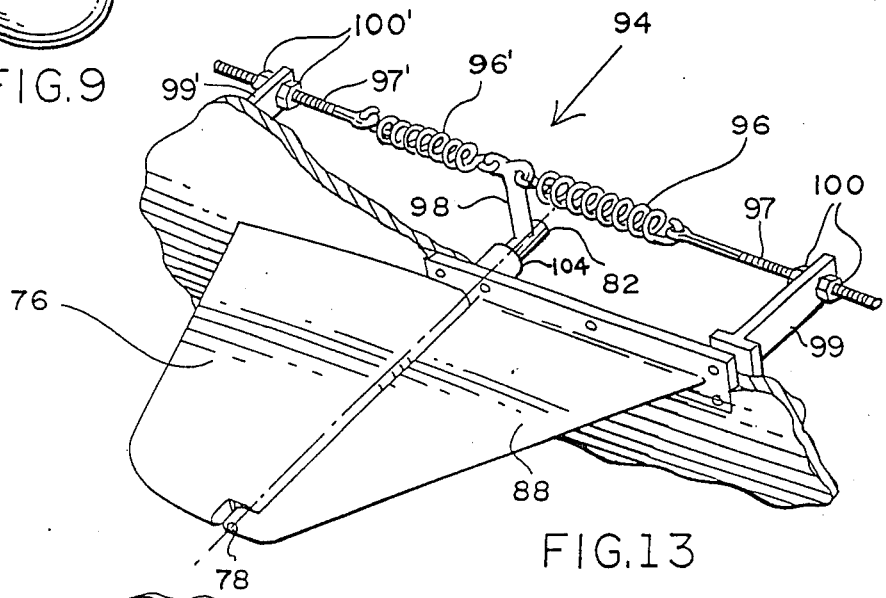
FIG. 13 is a fragmentary perspective view, with parts broken away, showing one embodiment of a roll stabilizer in accordance with the present invention.

FIG. 13 shows an alternative arrangement in which the single torsion spring 45 of FIG. 14 is replaced by a pair of opposed tension springs 96 and 96 inside the hull. The neighboring ends of these springs are attached to a short vertical post 98 extending up from the inner end of shaft 78. The outer ends of these springs are connected to screw-threaded tension bolts 97 and 97', respectively. Bolt 97 is threadedly received in nuts 100 on opposite sides of a fixed T-bar 99, and bolt 97' is threadedly received in nuts 100' on opposite sides of a fixed T-bar 99'. Bolts 97 and 97' adjust the opposing forces of springs 96 and 96' to normally hold the flap 76 in horizontal, co-planar alignment with the fixed vane 88.

In FIG. 13, element 104 is a waterproof fitting on the inside of the hull through which the shaft 78 extends. A similar fitting is provided in the embodiment of FIG. 14.

The pitching and rolling are reduced by the vertical resistance generated by the units as they are forced through the water by the ship's motion.

When the ship is pitching and the bow rises to a wave, the plate 28 swings down forcing the water to run aft. When the bow falls off a wave, the plate 28 swings up, again forcing the water to run aft. Both of these actions provide additional forward effort thus increasing the ship's speed.

The roll stabilizers operate in a similar manner. When the ship rolls to starboard, the starboard vanes 76 swing upward and the port vanes 76 swing down. Therefore both sides force water aft enhancing forward motion.

When the ship rolls to port, the port vanes 76 swing upward and the starboard vanes swing down forcing the water aft as before. So when the ship rolls either way, the vanes on both sides create a forward influence.

All the units have centering devices to reduce their drag when the ship is at low speed in calm water.

*Any* addition to the speed of a vessel especially, as in this case, at no increase in operating expense is vitally important. Not only is wear and tear reduced, fuel costs are reduced, and crew salary costs are reduced by spending less time at sea. Even a small increase in speed is important when one considers the thousands of miles and the thousands of days a ship spends at sea.

I claim:

1. On a water vessel having a hull with a bow and a water line, a pitch stabilizer comprising:

a substantially rigid support structure rigidly attached to the hull of the vessel at the bow and presenting a leading end segment which is completely below the water line of the vessel and completely above the bottom of the bow;

and flap means pivoted substantially horizontally on said support structure behind said leading end segment of the support structure and in front of the bow below the water line of the vessel and above the bottom of the bow.

2. The combination of claim 1 and further comprising:

pivot means for said flap means extending transverse to the longitudinal centerline of the vessel.

3. The combination of claim 2 wherein said pivot means extends substantially perpendicular to the longitudinal centerline of the vessel.

4. The combination of claim 3 wherein said flap means comprises a single, substantially rigid flap horizontally pivoted at its front end on said support structure immediately behind said leading end segment and extending rearward toward the bow of the vessel.

5. The combination of claim 2 and further comprising spring means biasing said flap means to a substantially horizontal position.

6. The combination of claim 5 wherein said spring means comprises upper and lower springs exerting opposing downward and upward forces on said flap means.

7. The combination of claim 5 wherein said spring means comprises torsion spring means acting between said flap means and said support structure.

8. On a water vessel having a hull with a bow and a water line, a pitch stabilizer comprising:

a substantially rigid support structure rigidly attached to the hull of the vessel at the bow and presenting a leading end segment below the water line of the vessel;

flap means pivoted substantially horizontally on said support structure behind said leading end segment of the support structure and in front of the bow;

and pivot means for said flap means extending substantially perpendicular to the longitudinal centerline of the vessel;

said flap means comprising a single, substantially rigid flap horizontally pivoted at its front end on said support structure immediately behind said leading end segment and extending rearward toward the bow of the vessel;

said support structure defining a horizontal opening in front of the bow and behind said leading end segment;

and said flap being closely received in said opening and being movable pivotally above and below said opening.

9. The combination of claim 8 and further comprising spring means biasing said flap to a substantially horizontal position in said opening.

10. On a water vessel having a hull with a bow and a water line, a pitch stabilizer comprising:

a substantially rigid support structure rigidly attached to the hull of the vessel at the bow and presenting a leading end segment below the water line of the vessel;

flap means pivoted substantially horizontally on said support structure behind said leading end segment of the support structure and in front of the bow;

pivot means for said flap means extending substantially perpendicular to the longitudinal centerline of the vessel;

said flap means comprising a single, substantially rigid flap horizontally pivoted at its front end on said support structure immediately behind said leading end segment and extending rearward toward the bow of the vessel;

and a spaced pair of substantially vertical fins, each extending from front to back along said flap and extending above and below said flap.

11. The combination of claim 10 wherein:

said fins extend along the opposite sides of said flap;

said support structure defines a horizontal opening in front of said bow and behind said leading end segment;

and said flap is closely received in said opening and is movable pivotally above and below said opening.

12. The combination of claim 11 and further comprising:

an upper stop member on each of said fins projecting laterally outward from the respective fin above said opening and engageable with said support structure to limit the pivotal movement of the flap downward with respect to said support structure;

and a lower stop member on each of said fins projecting laterally outward from the respective fin below said opening and engageable with said support structure to limit the pivotal movement of the flap upward with respect to said support structure.

13. The combination of claim 11 and further comprising spring means biasing said flap to a substantially horizontal position.

14. On a water vessel having a hull with a bow and a water line, a pitch stabilizer comprising:

a substantially rigid support structure rigidly attached to the hull of the vessel at the bow and presenting a leading end segment below the water line of the vessel;

flap means pivoted substantially horizontally on said support structure behind said leading end segment of the support structure and in front of the bow;

pivot means for said flap means extending substantially perpendicular to the longitudinal centerline of the vessel;

said flap means comprising a single, substantially rigid flap horizontally pivoted at its front end on said support structure immediately behind said leading end segment and extending rearward toward the bow of the vessel;

upper stop members on said support structure on opposite sides of said flap, said upper stop members projecting laterally inward over said flap to limit the pivotal movement of the flap upward with respect to said support structure;

and lower stop members on said support structure on opposite sides of said flap, said lower stop members projecting laterally inward below said flap to limit the pivotal movement of the flap downward with respect to said support structure.

15. On a water vessel having a hull with a bow and a water line, a pitch stabilizer comprising:

a substantially rigid support structure rigidly attached to the hull of the vessel at the bow and presenting a leading end segment below the water line of the vessel;

and flap means pivoted substantially horizontally on said support structure behind said leading end segment of the support structure and in front of the bow;

and pivot means for said flap means extending transverse to the longitudinal centerline of the vessel;

said flap means comprising a plurality of flaps in succession from front to back on said support structure behind said leading end segment of the support structure, each of said flaps being horizontally pivoted at its front end on said support structure.

16. The combination of claim 15 wherein:

said support structure defines a horizontal opening in front of the bow and behind said leading end segment;

and said flaps are closely received in said opening and are movable pivotally above and below said opening.

17. The combination of claim 16 and further comprising spring means biasing each of said flaps to a substantially horizontal position in said opening.

18. The combination of claim 1 and further comprising:

roll stabilizers on the opposite sides of said hull behind the bow and below the water line;

each of said roll stabilizers comprising a fixed vane extending substantially horizontally out from the hull, a horizontally pivoted flap directly behind said fixed vane, and spring means biasing said pivoted flap to a substantially horizontal position extending behind and substantially coplanar with said fixed vane.

* * * * *